166-307 SR
5/10/77 XR 4,022,275

United States Patent [19]

Brandon

[11] 4,022,275

[45] May 10, 1977

[54] METHODS OF USE OF SONIC WAVE GENERATORS AND MODULATORS WITHIN SUBSURFACE FLUID CONTAINING STRATA OR FORMATIONS

[75] Inventor: Clarence W. Brandon, Nashville, Tenn.

[73] Assignee: Orpha B. Brandon, Nashville, Tenn. ; a part interest

[22] Filed: July 6, 1976

[21] Appl. No.: 702,655

Related U.S. Application Data

[60] Division of Ser. No. 406,045, Oct. 12, 1973, Pat. No. 3,981,624, which is a continuation-in-part of Ser. No. 611,082, Jan. 23, 1967, Pat. No. 3,765,804, which is a continuation-in-part of Ser. No. 665,995, June 17, 1957, Pat. No. 3,302,720, which is a continuation-in-part of Ser. Nos. 296,038, June 27, 1952, Pat. No. 2,866,509, and Ser. No. 241,647, Aug. 13, 1951, Pat. No. 2,796,129.

[52] U.S. Cl. ..... 166/249; 166/250; 166/254; 166/286; 166/307; 166/308; 166/272; 166/312; 299/14

[51] Int. Cl.[2] ..... E21B 37/00; E21B 43/24; E21B 43/26; E21B 43/27

[58] Field of Search ..... 166/249, 250, 252, 254, 166/286, 307, 308, 268, 272, 271, 259, 303, 312, 177; 175/17, 56; 299/14; 417/240, 241

[56] References Cited

UNITED STATES PATENTS

| | | | |
|---|---|---|---|
| 2,072,982 | 3/1937 | Dale | 166/286 |
| 2,437,456 | 3/1948 | Bodine, Jr. | 166/249 X |
| 2,915,122 | 12/1959 | Hulse | 166/249 |
| 3,006,154 | 10/1961 | Brandon | 417/240 |
| 3,141,099 | 7/1964 | Brandon | 166/249 X |
| 3,189,092 | 6/1965 | Bodine | 166/249 |
| 3,255,601 | 6/1966 | Brandon | 166/177 |
| 3,640,344 | 2/1972 | Brandon | 166/249 |

FOREIGN PATENTS OR APPLICATIONS

| | | | |
|---|---|---|---|
| 462,509 | 3/1926 | Germany | 417/241 |

*Primary Examiner*—Stephen J. Novosad

[57] ABSTRACT

Various methods are shown as to the use of sonic wave generators, or sonic wave generators and modulators as to treating in the fracturing of, the acidizing of or the driving of fluids such as oil, gas or other fluids from subsurface fluid containing strata or formations. The use is shown of gaseous fluids being contained or injected within these subsurface fluid containing strata or formations for the reception of or localizing of these sonic waves of controllable or variable characteristics in this treating of or driving of fluids from these fluid containing subsurface strata or formations. The transporting of heat by these sonic waves into these fluid containing subsurface formations may be a contributing factor in the total effectiveness of these methods of treating or the driving and the subsequent recovery of fluids therefrom. These various and controllable sonic waves may be utilized as a source of seismic energy for delineating the type of fluid or formation existing in the subsurface strata or formations adjacent to or surrounding existing or drilled well bores.

93 Claims, 1 Drawing Figure

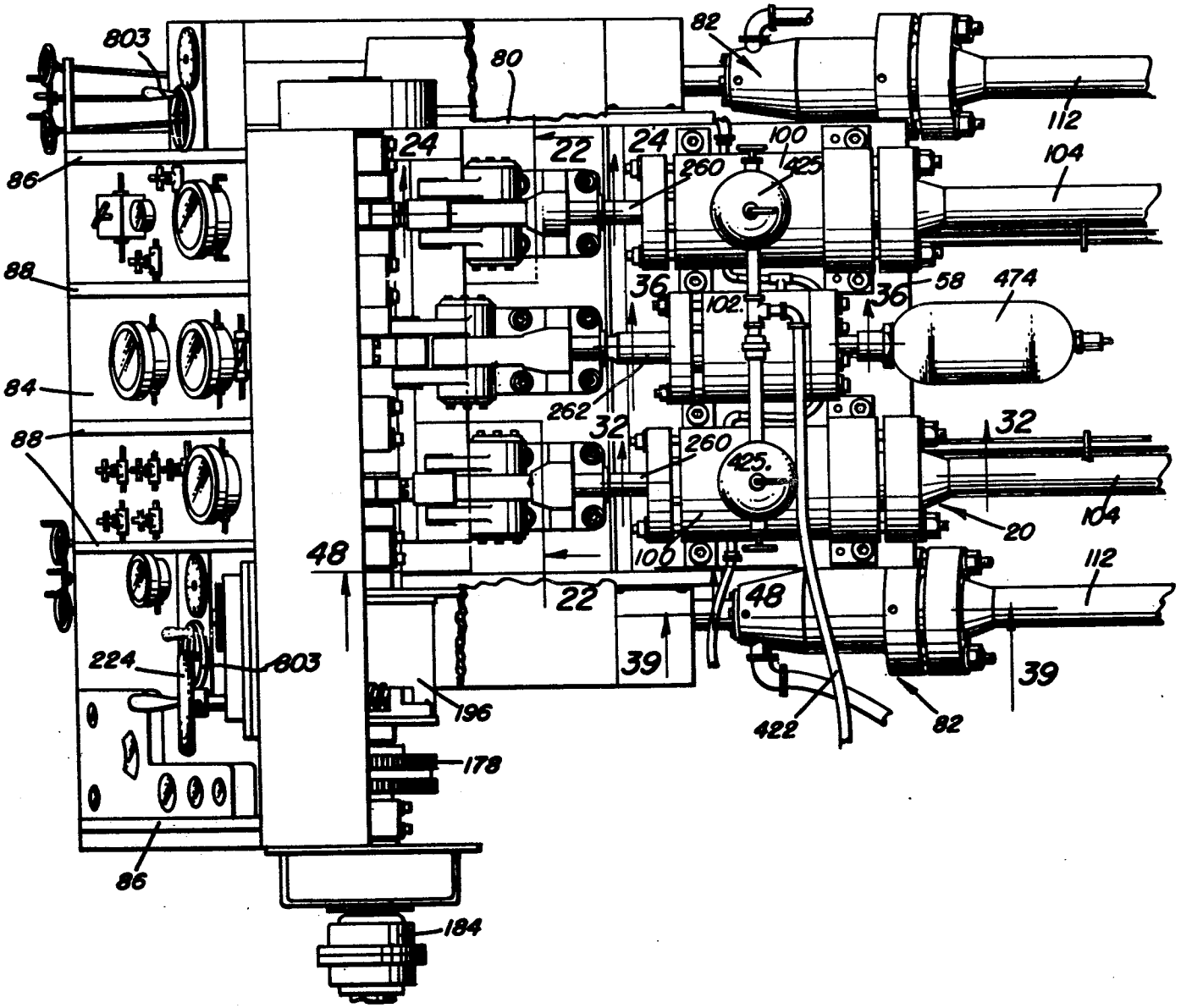
112
104
474
58
36
32
20
39
82
100
425
102
260
24
22
80
262
48
422
196
178
184
803
224
86
88
84

METHODS OF USE OF SONIC WAVE GENERATORS AND MODULATORS WITHIN SUBSURFACE FLUID CONTAINING STRATA OR FORMATIONS

CROSS-REFERENCES TO RELATED APPLICATIONS

This invention comprises improvements in various uses of sonic waves in the treating of or driving fluids from oil, gas or other subsurface fluid containing strata or formations by the use of sonic waves of variable and controllable characteristics and heat utilized for assisting in this treating of or driving of fluids from fluid containing strata or formations and constitutes a division of my application Ser. No. 406,045 filled Oct. 12, 1973, U.S. Pat. No. 3,981,624; which is a continuation-in-part of application Ser. No. 611,082 filed Jan. 23, 1967, U.S. Pat. No. 3,765,804; which is a continuation-in-part of my prior application Ser. No. 655,995 filed June 17, 1957. U.S. Pat. No. 3,302,720; which in turn is a continuation-in-part of my original applications Ser. No. 296,038 filed June 27, 1952, U.S. Pat. No. 2,866,509; and Ser. No. 241,647 filed Aug. 13, 1951, U.S. Pat. No. 2,796,129.

The accompanying drawing forming part thereof, corresponds to FIG. 5 of the drawings of the above allowed co-pending application Ser. No. 406,045, of which the entire specification and drawings are incorporated herein by reference to support the claims or constitute an adequate disclosure of the invention.

DESCRIPTION AND DISCLOSURE OF THE CLAIMED INVENTION

The apparatus shown in the present invention includes one or more sonic wave generators and one or more modulators in operative phase angle relationship and connection thereto. The present methods of the claimed inventions may be performed with one of the shown sonic wave generators, with two of the generators attached in phase angle relationship, with one of the sonic wave generators and modulators or with two or more sonic wave generators and modulators attached in phase angle relationship and connection therewith. For informative knowledge of how to perform any or all of these claimed methods by any of the variable and controllable apparatus disclosed above I refer you to my co-pending application Ser. No. 406,045 filed Oct. 12, 1973, now U.S. Pat. No. 3,981,624, of which the present application is a division.

What I claim:

1. That method of maintaining a predetermined pressure upon a fluid medium and thereby transmitting a sonic wave between a sonic wave generator and a means of reception comprising oscillating a valve in head piston between a compressible energy storage means and a column of pressured fluid contacting said means of sonic wave reception, making up losses in the predetermined pressure of said fluid medium by admittance of additional fluid through said piston valve from a source of pressured fluid during accelerated rarefaction oscillations of said piston against said compressible energy storage means, adding said additional fluid into said fluid medium during compressional oscillations of said piston, including increasing the pressure being maintained on said fluid medium column by increasing the accelerations imposed on said rarefaction oscillations, wherein said means of reception is an oil, gas or water containing subsurface strata or formation.

2. The method of claim 1 wherein a gaseous fluid is contained or injected within said subsurface strata or formation.

3. The method of claim 2 wherein said transmitting fluid column is maintained in a substantially liquid phase during said rarefaction and compression oscillations, and said reception means becomes substantially gaseous during at least the reception of said rarefaction oscillations.

4. The method of claim 2 wherein said subsurface strata or formation accumulates sonic wave energy.

5. The method of claim 2 wherein said injected gas is a drive fluid or flooding means for recovering fluids from said subsurface formation.

6. The method of claim 5 including driving said injected gas and said fluid reception means through said subsurface formation by said sonic wave and a waterflood for said fluid recovery therefrom.

7. The method of claim 2 wherein said contained or injected gas assists in the fracturing of said formation.

8. The method of claim 7 including assisting in the fracturing of said formation by said increasing of said heat into said gaseous fluid medium.

9. The method of claim 2 wherein said contained or injected gas assists in the increasing or decreasing of said heat into or from said fluid medium.

10. The method of claim 1 including increasing the intensity of said transported sonic wave by increasing the compressional accelerations of said oscillation imposed by said piston.

11. The method of claim 1 wherein said fluid medium is a drive fluid or flooding means for recovering fluids from said subsurface formation.

12. The method of claim 11 wherein said drive fluid or flooding means for recovering fluids is a waterflood.

13. The method of claim 1 wherein said formation is fractured by said transported sonic wave.

14. The method of claim 13 wherein said fluid medium is inclusive of an acidizing or dissolving agent which assists said fracturing in increasing the flow capacity of fluids through said formation.

15. The method of claim 14 wherein said fluid medium is an acidizing or dissolving agent.

16. The method of claim 13 including increasing the energy content of said transported sonic wave and the fracturing of said formation by increasing the heat content of said fluid medium.

17. The method of claim 13 includng testing recovery of fluids from said subsurface strata or formation after the fracture of said formation.

18. The method of claim 17 including following said fluid recovery test from said strata or formation by a cementing or plugging agent.

19. The method of claim 1 wherein said fluid medium is inclusive of an acidizing or dissolving agent which assists in increasing the flow capacity of fluids through said formation or strata.

20. The method of claim 19 wherein said fluid medium is an acidizing or dissolving agent.

21. The method of claim 19 including testing recovery of fluids from said subsurface strata or formation after the acidizing of said formation.

22. The method of claim 21 including following said fluid recovery test from said strata or formation by a cementing or plugging agent.

23. The method of claim 1 including increasing or decreasing the energy content of the generated and transmitted sonic wave by applying or withdrawing heat from the fluid medium applied to the sonic wave generator.

24. The method of claim 1 wherein said fluid medium is a strata or formation cementing agent.

25. The method of claim 24 wherein a gaseous fluid is contained or injected within said subsurface strata or formation.

26. The method of claim 1 wherein said means of reception includes well bores being drilled into said subsurface strata or formation.

27. The method of claim 1 wherein said transmitted sonic wave is used as a seismic signal source for delineation of subsurface formations or fluids.

28. The method of claim 1 including imposing cavitational modulations upon said sonic wave during said accelerated rarefaction oscillations, transporting said modulations to said reception means by said sonic wave.

29. The method of claim 28 including varying the phase angle of said cavitational modulation in relation to said rarefacton oscillations of said transporting sonic wave.

30. The method of claim 29 wherein said fluid medium is inclusive of an acidizing or dissolving agent for increasing the flow capacity of fluids through said formation.

31. The method of claim 30 wherein a gaseous fluid is contained or injected into said subsurface formation for the reception of said transported sonic wave energy and assisting in said reception as to increasing the flow capacity of fluids through said formation.

32. The method of claim 31 wherein said transmitting fluid column is maintained in a substantially liquid phase during said compression and modulated rarefaction oscillation, and said reception means becomes substantially gaseous during at least the reception of said modulated rarefaction oscillations.

33. The method of claim 32 includng testing recovery of fluids from said acidized formation.

34. The method of claim 33 including following said fluid recovery test by a cementing or plugging agent.

35. The method of claim 30 including increasing the energy content of said transported sonic wave and the flow capacity of fluids through said formation by increasing the heat content of said fluid medium being admitted through said piston.

36. The method of claim 30 wherein said fluid medium is a formation acidizing or dissolving agent.

37. The method of claim 28 wherein said cavitational modulation comprises withdrawing pressured fluid and sonic wave energy from said pressured fluid column transmitting said sonic wave energy to said reception means.

38. The method of claim 37 including varying the phase angle of said withdrawal of said pressured fluid and sonic wave energy in relation to said rarefaction oscillations of said transporting sonic wave.

39. The method of claim 37 wherein said withdrawal of pressured fluid and sonic energy is achieved by opening of a discharge valve in timed relationship to said oscillation of said piston.

40. The method of claim 28 wherein said subsurface strata or formation accumulates sonic wave energy.

41. The method of claim 28 wherein a gaseous fluid is contained or injected within said subsurface strata or formation.

42. The method of claim 41 wherein said injected gas is a drive fluid or flooding means for recovering fluids from said subsurface formation.

43. The method of claim 42 including driving said injected gas and said fluid reception means through said subsurface formation by said sonic wave and a waterflood for said fluid recovery therefrom.

44. The method of claim 43 wherein said transmitting fluid column is maintained in a substantially liquid phase during said compression and modulated rarefaction oscillations, and said reception means becomes substantially gaseous during at least the reception of said modulated rarefaction oscillations.

45. The method of claim 42 including increasing the energy content of said transported sonic wave and the recovery of fluids from said subsurface formation by increasing the heat content of said fluid medium being admitted through said piston.

46. The method of claim 42 wherein said transmitting fluid column is maintained in a substantially liquid phase during said compression and modulated rarefaction oscillations, and said reception means becomes substantially gaseous during at least the reception of said modulated rarefaction oscillations.

47. The method of claim 41 wherein said contained or injected gas assists in the fracturing of said formation.

48. The method of claim 47 wherein said transmitting fluid column is maintained in a substantially liquid phase during said compression and modulated rarefaction oscillations, and said reception means becomes substantially gaseous during at least the reception of said modulated rarefaction oscillations.

49. The method of claim 48 including varying the phase angle of said cavitational modulation in relation to said rarefaction oscillations of said transporting sonic wave.

50. The method of claim 49 including increasing the energy content of said transported sonic wave and the fracturing of said formation by increasing the heat content of said fluid medium being admitted through said piston.

51. The method of claim 48 including testing recovery of fluids from said fractured formation.

52. The method of claim 51 including following said fluid recovery test by a cementing or plugging agent.

53. The method of claim 41 wherein said gaseous fluid is a formation fluid reception means for the transported modulated sonic wave energy and the recovery of oil, gas or other fluids from said fluid containing subsurface formation.

54. The method of claim 53 including increasing the energy content of said transported sonic wave and the recovery of fluids from said subsurface formation by increasing the heat content of said fluid medium being admitted through said piston.

55. The method of claim 53 wherein said transmitting fluid column is maintained in a substantially liquid phase during said compresson and modulated rarefaction oscillations, and said reception means becomes substantially gaseous during at least the reception of said modulated rarefaction oscillations.

56. The method of claim 55 including testing recovery of fluids from the using of said transported modulated sonic wave energy.

57. The method of claim 55 wherein said means of reception of said transported modulated sonic wave energy includes well bores being drilled into said subsurface strata or formation.

58. The method of claim 55 wherein said transmitted or transported modulated sonic wave energy is used as a seismic signal source for delineation of subsurface formations or fluids.

59. The method of claim 58 including producing a recognizable seismic signal by varying the phase angle of said cavitational modulation in relation to said rarefaction oscillations of said transporting sonic wave.

60. The method of claim 28 wherein said fluid medium is a drive fluid or flooding means for recovering fluids from said subsurface formation.

61. The method of claim 60 wherein drive fluid or flooding means for recovering fluids is a waterflood.

62. The method of claim 28 wherein said formation is fractured by said transported sonic wave.

63. The method of claim 62 wherein said fluid medium is inclusive of an acidizing or dissolving agent which assists said fracturing in increasing the flow capacity of fluids through said formation.

64. The method of claim 63 wherein said reception means within said subsurface strata or formation contains or has injected thereinto a gaseous fluid.

65. The method of claim 64 wherein said transmitting fluid column is maintained in a substantially liquid phase during said compression and modulated rarefaction oscillations, and said reception means becomes substantially gaseous during at least the reception of said modulated rarefaction oscillations.

66. The method of claim 65 including varying the phase angle of said cavitational modulation in relation to said rarefaction oscillations of said transporting sonic wave.

67. The method of claim 66 including increasing the energy content of said transported sonic wave and increasing the flow capacity of fluids through said formation by increasing the heat content of said fluid medium being admitted through said piston.

68. The method of claim 65 including testing recovery of fluids from said fractured and acidized formation.

69. The method of claim 68 including following said fluid recovery test by a cementing or plugging agent.

70. The method of claim 63 including increasing the energy content of said transported sonic wave and increasing the flow capacity of fluids through said formation by increasing the heat content of said fluid medium being admitted through said piston.

71. The method of claim 62 including increasing the intensity of said transported sonic wave by increasing the compressional accelerations of said oscillation imposed by said piston.

72. The method of claim 62 including increasing the energy content of said transported sonic wave and the fracturing of said formation by increasing the heat content of said fluid medium being admitted through said piston.

73. The method of claim 1 including oscillating at a phase angle a second of said generators from a common drive means, controlling the admittance of pressured fluid through said second generator, transmitting sonic waves from said second generator to said sonic wave reception means in the fluids of said formation to combine with the sonic wave from said first generator, creating at said reception means in the fluids of said formation sonic waves of controllable characteristics.

74. The method of claim 73 including imposing cavitational modulations upon the sonic waves from said second generator, transporting said modulations to said reception means by said sonic waves from said second generator.

75. The method of claim 74 including imposing cavitational modulations upon the sonic wave from said first generator, transporting by sonic waves the modulations from both of said generators to said reception means in the fluids of said formation, creating in said formation fluids modulated sonic waves of variable characteristics.

76. The method of claim 75 including varying the phase angle of the cavitational modulations of each of said generators in relation to the transporting sonic waves to said formation fluids from both the first and second of said sonic wave generators.

77. The method of claim 76 wherein said formation is fractured.

78. The method of claim 76 wherein a gaseous fluid is contained or injected within said subsurface formation.

79. The method of claim 78 wherein said gaseous fluid is a formation fluid reception means for the transported modulated sonic wave energy and the recovery of oil, gas or other fluids from said fluid containing subsurface formation.

80. The method of claim 78 wherein said fluid medium is inclusive of an acidizing or dissolving agent for increasing the flow capacity of fluids through said formation.

81. The method of claim 80 wherein said formation is fractured and said acidizing or dissolving agent assists said fracturing in increasing the flow capacity of fluids through said formation.

82. The method of claim 78 wherein the reception of said modulated sonic wave energy from both of said sonic wave generators by said gaseous fluid fractures said formation.

83. The method of claim 78 wherein the gaseous fluid contained or injected into said fluid containing formation assists in localizing the reception of said modulated sonic wave energy from both of said generators and modulators and the producing of a recognizable seismic signal for delineation of subsurface formations or fluids.

84. The method of claim 76 wherein the reception of said modulated sonic wave energy from both of said generators and modulators by said formation fluid produces a recognizable seismic signal for delineation of subsurface formations or fluids.

85. The method of claim 73 including heating the fluid controllably admitted through said second generator, compressing heat from said fluid into said second generated sonic wave, heating the fluid admitted through said first generator, compressing the heat from said fluid into said first generated sonic wave, transporting to said sonic wave reception means within said formation fluid said heat compressed from the fluid admitted to both sonic wave wave generators.

86. The method of claim 85 including imposing cavitational modulations of variable phase angle upon both of said generators, assisting by said modulations the compressing of said heat into said fluid being compressed by said generators, and in the transporting to said sonic wave reception means within said formation fluid said heat compressed from heated fluid admitted to both said sonic wave generators and modulators.

87. The method of claim 86 wherein a gaseous fluid is contained or injected within said subsurface fluid containing formation.

88. The method of claim 87 wherein said gaseous fluid within said formation fluid is a fluid reception means for the transported heat containing modulated sonic wave energy and assists in the recovery of oil, gas or other fluids from said fluid containing subsurface formation.

89. The method of claim 88 wherein said transmitting fluid column is maintained in a substantially liquid phase during said transporting heated compression and modulated rarefaction oscillations, and said reception means beccomes substantially gaseous during at least the reception of said heat localizing modulated rarefaction oscillations.

90. The method of claim 89 wherein the reception of said heated modulated sonic wave energy by said formation fluid produces recognizable seismic signals for delineation of subsurface formations or fluids.

91. The method of claim 89 wherein said fluid medium is inclusive of an acidizing or dissolving agent for increasing the flow capacity of fluids through said formation.

92. The method of claim 89 wherein the reception of said heated modulated sonic wave energy by said gaseous fluid fractures said formation.

93. The method of claim 91 wherein said formation is fractured and said acidizing or dissolving agent assists said fracturing in increasing the flow capacity of fluids through said formation.

* * * * *